US005507064A

United States Patent [19]

King

[11] Patent Number: 5,507,064

[45] Date of Patent: Apr. 16, 1996

[54] WOOD GRAINING TOOLS

[76] Inventor: Clifford M. King, 1120 S. Sterling, Independence, Mo. 64065

[21] Appl. No.: 281,588

[22] Filed: Jul. 28, 1994

[51] Int. Cl.[6] ..... A47K 7/02; B27M 1/02

[52] U.S. Cl. ..... 15/210.5; 101/3.1; 101/23; 101/32; 144/3 N; 144/362; 144/380; 492/30

[58] Field of Search ..... 492/16, 17, 18, 492/19, 30, 37, 49, 56, 60; 101/3.1, 5, 6, 22, 23, 32; 15/210.5; 144/3 N, 136 J, 329, 361, 362, 380

[56] References Cited

U.S. PATENT DOCUMENTS

| | | | |
|---|---|---|---|
| 1,441,922 | 1/1923 | Gstalder | 15/210.5 |
| 1,573,594 | 2/1926 | Winkenbach | 15/210.5 |
| 2,724,642 | 11/1955 | Brown | 144/380 |
| 3,095,634 | 7/1963 | Williams et al. | 101/22 X |
| 3,327,369 | 6/1967 | Catlin | 101/23 |
| 3,486,919 | 12/1969 | Dreazy et al. | 101/32 |
| 3,843,992 | 10/1974 | Briggs | 15/210.5 |

FOREIGN PATENT DOCUMENTS 44871 5/1908 Switzerland .

OTHER PUBLICATIONS

"Basic Wood Graining Oak", American Wood Graining Products brochure Clifford M. King, 1981.

*Primary Examiner*—W. Donald Bray

*Attorney, Agent, or Firm*—Chase & Yakimo

[57] ABSTRACT

A series of wood graining tools for producing wood grain patterns corresponding to plain sawn, quarter sawn and/or rotary cut woods, on an application surface. The plain sawn tool presents a graining pattern having a plurality of crown-shaped embossed ribs thereon. Each rib is formed by utilizing a series of rib arcs with lateral ribs extending therefrom at a preferred angle of 40° to 50° relative to the horizontal. The quarter sawn pattern presents a series of embossed ribs diagonally extending across the pattern and decreasing in density from one corner of the panel to the center thereof. A rotary cut pattern is presented by first and second arcuate ribs positioned so that one rib will channel the graining liquid to the other to produce a ring on the application surface during rolling movement of the tool.

8 Claims, 9 Drawing Sheets

WOOD GRAINING TOOLS

BACKGROUND OF THE INVENTION

This invention pertains to wood graining tools and, more particularly, to tools which are particularly designed to effectively simulate the grain patterns of variously sawn woods.

The annular growth rings of trees display primary grain patterns according to the method utilized in sawing the wood. Thus, the resulting grain patterns of plain sawn, quarter sawn and rotary cut woods will vary in their display. Accordingly, it is desirable to produce wood graining tools which can easily simulate these various graining patterns. A method of wood graining is described in my 1981 *Basic Wood Graining Oak* which is hereby incorporated by reference herein.

The Briggs U.S. Pat. No. 3,843,992 discloses a wood graining tool with a well-known corrugated pattern thereon. This pattern is said to produce a heart grain effect. A heart grain effect is characterized by a plurality of first and second veins terminating in crowns spaced along the surface. This pattern is presented by a plain sawn cut of a tree.

The Briggs device also has a comb which is drawn along the graining liquid on the application surface so as to produce a series of parallel veins which is said to simulate a quarter sawn grain pattern.

The Briggs device does not produce a rotary cut type of wood grain pattern which is characterized by an annular ring of rings appearing in the graining pattern.

One problem with past tools is that the graining patterns in the tool presented predictable and ineffectual wood grain patterns. More importantly, as these tools use a series of increasingly larger circular ribs to present the grain pattern, portions of these ribs relative to the trailing edge of the tool approach angles of 90°. As such rib portions approach a parallelism to the direction of tool travel, the graining liquid on the application surface will pass between these ribs untouched. Thus, the ribs cannot effectively interface with the graining liquid on the application surface. Moreover, as the radius of the rib arcs increases along the length of the graining tool pattern, the radii of the rib arcs at the top of the tool become so large that they become ineffective to produce a proper crown of a plain sawn wood grain pattern.

As to quarter sawn woods, prior tools utilized combs having fixed teeth thereof drawn along the application surface so as to space the graining liquid thereon. The fixed relationship of the teeth hindered the variability of the resulting wood grain pattern.

Finally, in making a plain sawn cut grain pattern, i.e. a closed loop or series of closed grain loops appear in the wood grain pattern, it was necessary to slide and roll a tool along the application surface in one direction to make a first portion of the loop and then reverse the rolling motion of the tool while maintaining the forward sliding motion of the tool to present a second loop so as to close the loop. Thus, it was difficult to easily and effectively present such loops as the required rocking motion of the tool produced light and dark shades on the graining pattern as it was either lifting the liquid off the surface or depositing the liquid on the surface. Moreover, in order to apply a series of loops along an extended application surface it was necessary to roll the tool back and forth several times which aggravated the above problems.

In response thereto I have invented a wood graining tool having a plain sawn graining pattern thereon which presents a series of crown-shaped ribs having rib arcs of a constant radius. The ribs are displaced along a longitudinally extending centerline of the tool pattern. Laterally extending ribs emanate from each rib arc at an angle of 40° to 50° relative to the horizontal. This angular relationship affords a proper pick up and placement by the ribs of the graining liquid on the application surface. The use of rib arcs of constant radius along with the lateral ribs at selected angles present effective ribs along the entire tool length which enhance the graining liquid pick up and pattern application.

As to a quarter sawn grain pattern, my second tool presents a plurality of ribs diagonally extending across the tool and being of variously spaced distances therebetween. This rib pattern presents a continually changing number of rib contact points with the application surface so as to present a variable vein pattern when the tool is rolled along the length of the application surface.

Finally, I provide a rib pattern on a graining tool which will easily produce the loops found in a plain sawn cut wood grain pattern. My tool generally comprises a first arcuate, concave rib and a second arcuate, convex rib. Upon rolling movement of the tool in a single direction the graining liquid is efficiently directed between the ribs so as to produce an annular ring or series of rings on the application surface.

It is therefore an object of this invention to provide a wood graining tool which will provide an effective wood graining pattern corresponding to a plain sawn wood.

Another object of this invention is to provide a wood graining tool which will provide an effective wood grain pattern corresponding to a quarter sawn wood.

Still another object of this invention is to provide a wood graining tool which will provide an effective wood grain pattern corresponding to a rotary cut wood.

A still further object of this invention is to provide a wood graining tool with graining pattern thereon which is effective in graining liquid pick up, distribution and application.

Still another object of this invention is to provide a wood graining tool, as aforesaid, which provides an effective working pattern across the length and width of the wood graining tool.

Another particular object of this invention is to provide a wood graining tool with quarter sawn pattern, as aforesaid, which produces a variable quarter sawn pattern along the length of the application surface.

Still another object of this invention is to provide a wood graining tool with plain sawn cut pattern, as aforesaid, which effectively presents an enclosed loop or loops upon movement of the tool in one direction on the application surface without rocking the tool.

A still more particular object of this invention is to provide a plain sawn wood graining tool, as aforesaid, having a plurality of crown-shaped ribs thereon each comprising an arc of a constant radius positioned along a longitudinal line of the tool with ribs emanating therefrom at selected angles relative to the horizontal.

Still another particular object of this invention is to provide a quarter sawn wood graining tool, as aforesaid, which comprises a series of graining ribs extending diagonally across the tool.

Another object of this invention is to provide a tool, as aforesaid, which utilizes a selected pattern of graining ribs so as to effectively pick up and apply paint for making a closed loop found in a rotary cut or plain sawn cut wood grain pattern.

Other objects and advantages of this invention will become apparent from the following description taken in connection with the accompanying drawings, wherein is set forth by way of illustration and example, certain embodiments of this invention.

DESCRIPTION OF THE PREFERRED EMBODIMENT

Figure 1:
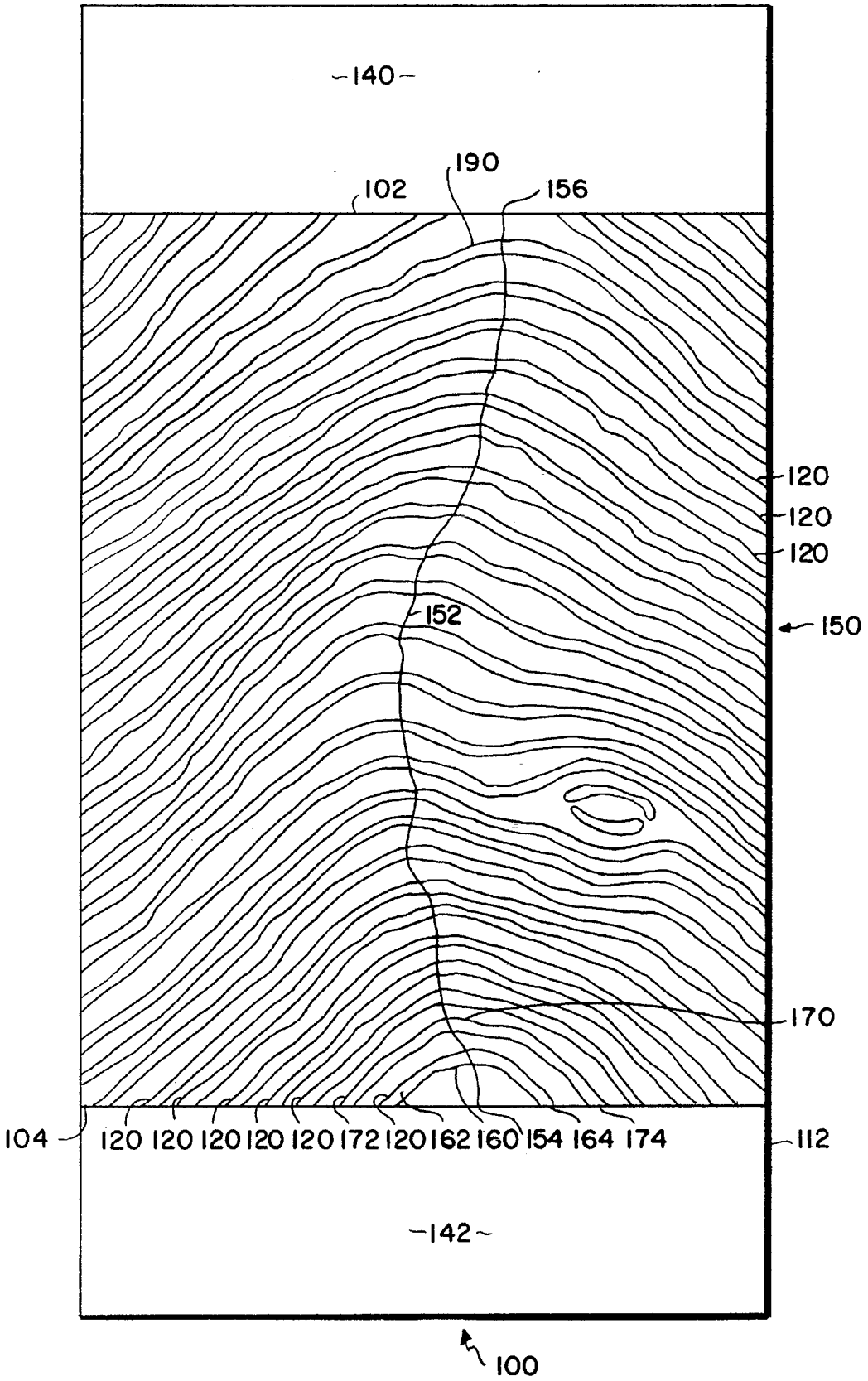
FIG. 1 is a plan view of a wood graining tool having a graining pattern for primarily producing a plain sawn wood grain pattern with closed loop.

Turning more particularly to the drawings, FIG. 1 shows a first wood graining tool 100 as comprising a rectangular panel 112 of flexible rubber or the like having a plain sawn graining pattern 150 embossed thereon. The pattern 150 of tool 100 as viewed presents a top or leading edge 102 and a lower or trailing edge 104. The edges 102, 104 are generally normal to the direction of the line of travel when the tool 100, as wrapped around a cylinder, is moved along an application surface. A user rotation of the tool 100 about the cylinder's axis and a concurrent user sliding of the tool along a generally straight line of travel of a prepared application surface presents a wood grain pattern on the application surface. (The application surface has been previously prepared with a base coat and a graining liquid.) Planar seats 140, 142, adjacent the edges 102, 104 allow the user's fingers to grasp the tool 100 without interference with the pattern 150. An explanation of user movement of a tool cylinder wrapped is as shown in my 1981 book entitled *Basic Wood Graining Oak,* which is incorporated herein.

As shown in FIG. 1, the graining pattern 150 is presented by a plurality of crown-shaped ribs 120 raised from the planar background surface of the tool pattern 150. An imaginary line 152 longitudinally extending between point 154 on lower edge 104 and point 156 on the upper edge 102. The chosen longitudinal line may be a straight, longitudinal centerline as well a curvilinear centerline (FIG. 1) extending between points 154, 156.

The ribs are positioned in the pattern 150 as follows. A fixed radius is chosen for the arc portion of each rib with the center point of the arc being positioned along the imaginary line 152 or extensions thereof. A first lower rib arc 160, as defined by this chosen radius, presents the crown portion of the lower crown-shaped rib. Ribs 162, 164 meld within this rib arc 160 and extend therefrom at an angle of approximately 40° to 50° relative to the horizontal as defined by lower edge 104. Thus, the combination of rib arc 160 and melded ribs 162, 164 present the first or lowermost crown-shaped rib on pattern 150. A subsequent rib arc 170, utilizing the same arc radius as rib 160, is displaced from this first rib arc 160. Again, melded ribs 172, 174 downwardly extend from this rib arc 170 at an angle between 40° to 50° relative to the horizontal. This rib pattern is repeated along the centerline 154 and extensions thereof beyond point 156 until the pattern 150 is full. (The crowns and portions of the melded ribs do not appear in the pattern 150 adjacent the top edge 102 as they will lie beyond the upper edge 102.) As shown in FIG. 1, the crown-shaped ribs are defined by fluctuating edges.

As all the ribs extending from the arcs or crowns in each crown-shaped rib 120 in the pattern 150 are preferably no less than 40° and no greater than 50° relative to the horizontal (0°), the extending ribs, e.g. 162, 164, do not approach the direction of travel of the tool. Thus, the plurality of extending ribs are effective in moving the graining liquid onto the application surface in the desired graining pattern as the graining liquid will not pass untouched through the adjacent ribs.

Moreover, as the radius of each rib arc in prior tools increased as the top of the tool pattern was approached, the upper rib arcs became increasingly unproductive as the ribs of large arcs do not produce proper hearts or crowns of an effective wood grain pattern. As the radius of the arcs in each crown-shaped rib in tool 100 remains constant throughout the pattern 150, the arcs of the crown-shaped ribs of the graining pattern 150 remain functionally effective throughout the longitudinal extent of the graining pattern 150.

Finally, as the radius of each rib arc remains the same the length of the tool pattern 150 can be variously adjusted. In the prior art a longitudinal extension of the graining pattern was not effective as the addition of rib arcs of a necessarily larger radius was not possible at the upper edge of the tool pattern.

Figure 6:
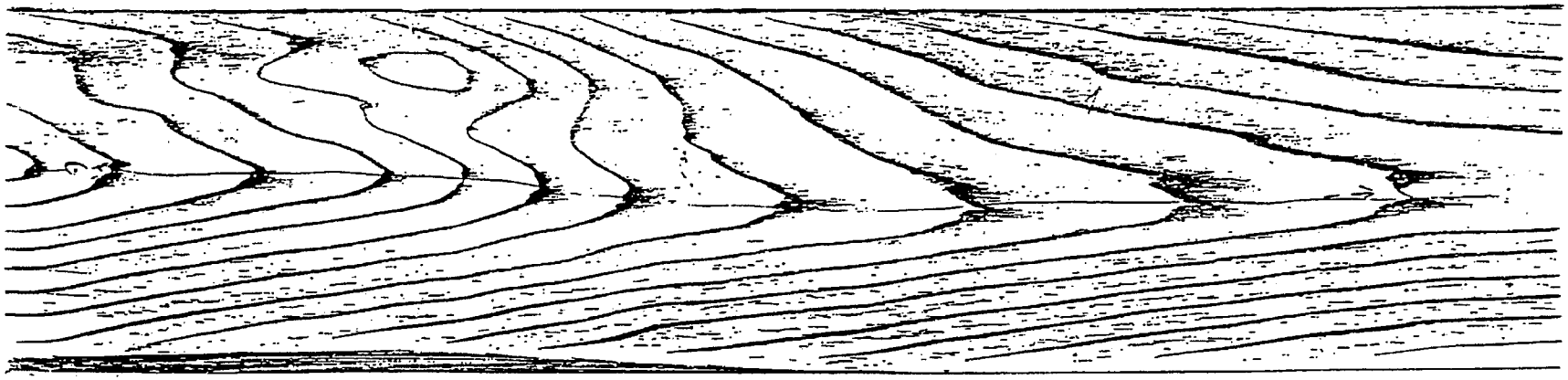
FIG. 6 is a view of an application surface having a plain sawn or heart wood grain pattern thereon made by the FIG. 1 tool with closed loop.

I have found that this graining pattern 150, i.e. the use of arcs of a constant radius displaced along a centerline 152 with melded ribs extending therefrom at an angle of 40° to 50° relative to the horizontal presents an effective wood graining tool 100. This tool 100 will present an effective plain sawn wood grain pattern on an application surface one such grain pattern being shown in FIG. 6.

Figure 3:
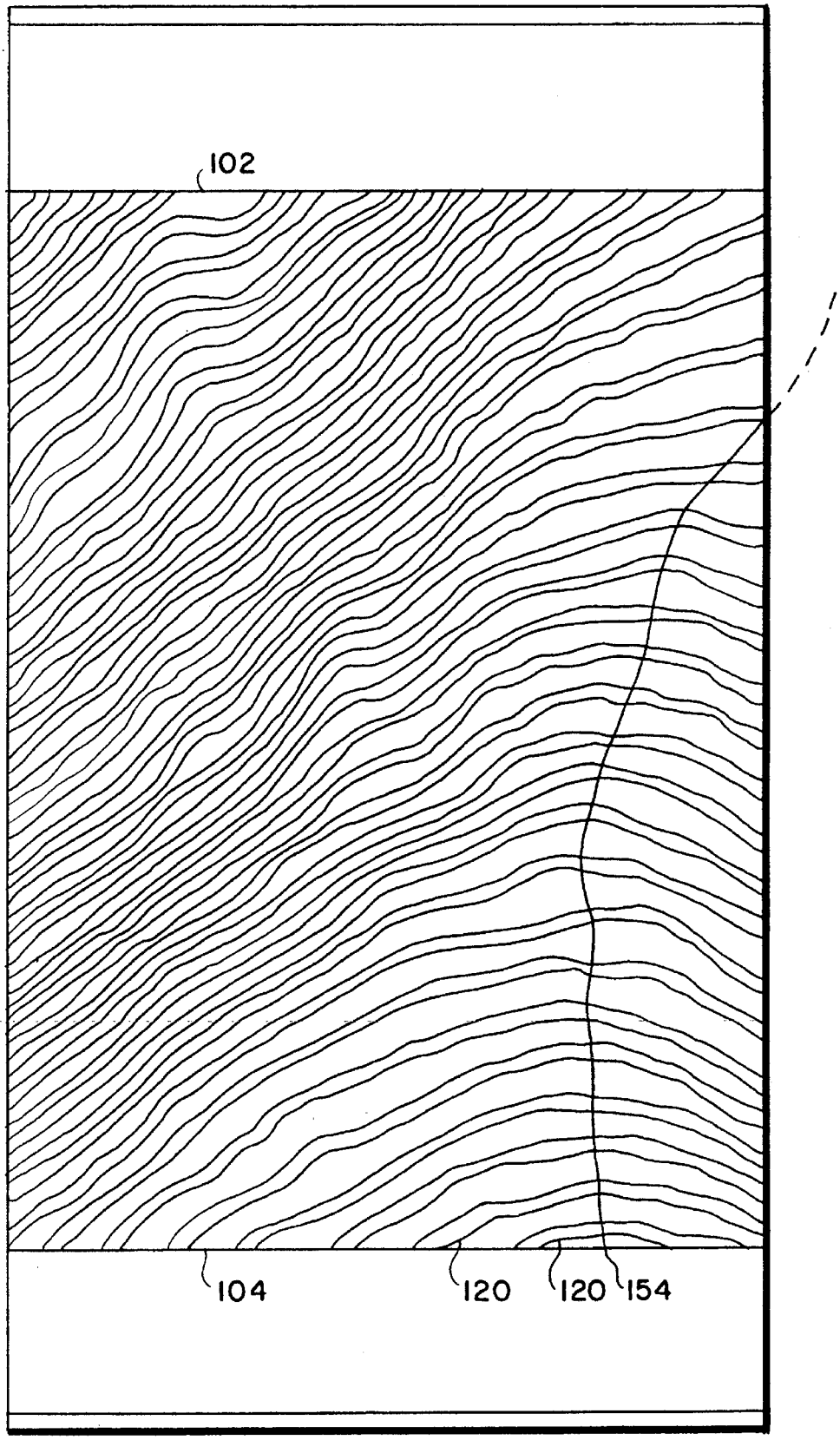
FIG. 3 is a plan view of a pattern of a wood graining tool having a graining pattern for primarily producing a plain sawn wood grain with the wood heart bleeding off to one side.
Figure 8:
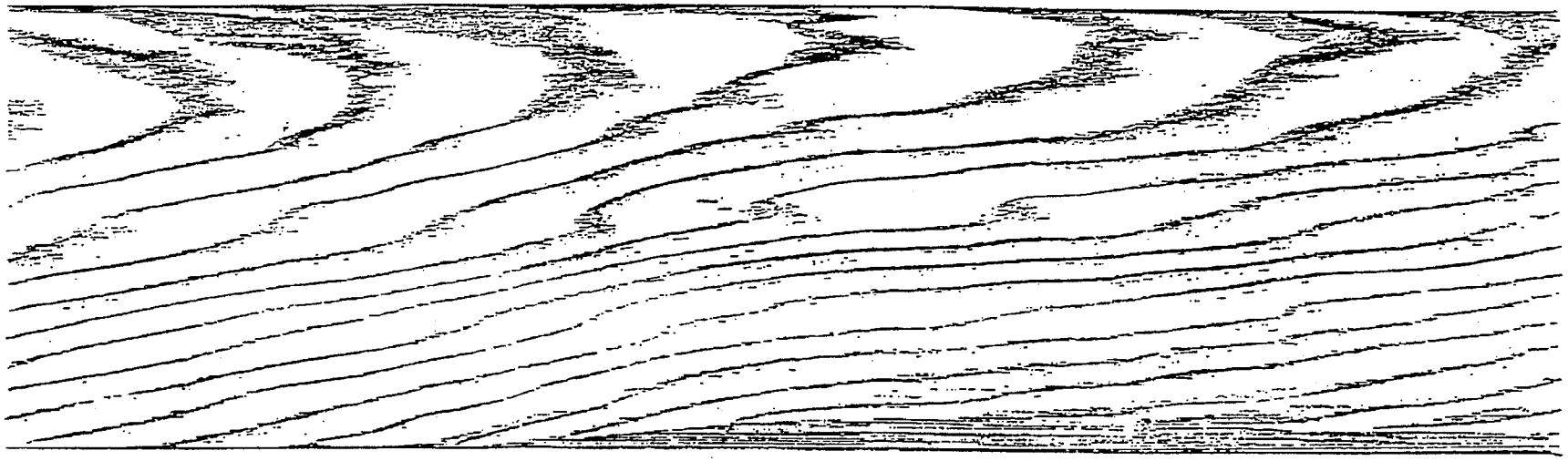
FIG. 8 is a view of an application surface primarily showing a plain sawn wood grain pattern thereon offset to the side as made by the FIG. 3 tool and bleeding off to one side.

FIG. 3 shows another plain saw graining pattern, as above described, with a curvilinear longitudinal line positioned to the right of the medial centerline. Although not shown, it is understood that the longitudinal line may be positioned to the left of the medial centerline. Thus, the concepts of formation of a plurality of crown-shaped ribs, as above described, may be used in connection with variously positioned straight and/or curvilinear lines extending between the upper and lower edges 102, 104. A resulting wood grain pattern is as shown in FIG. 8.

Figure 2:
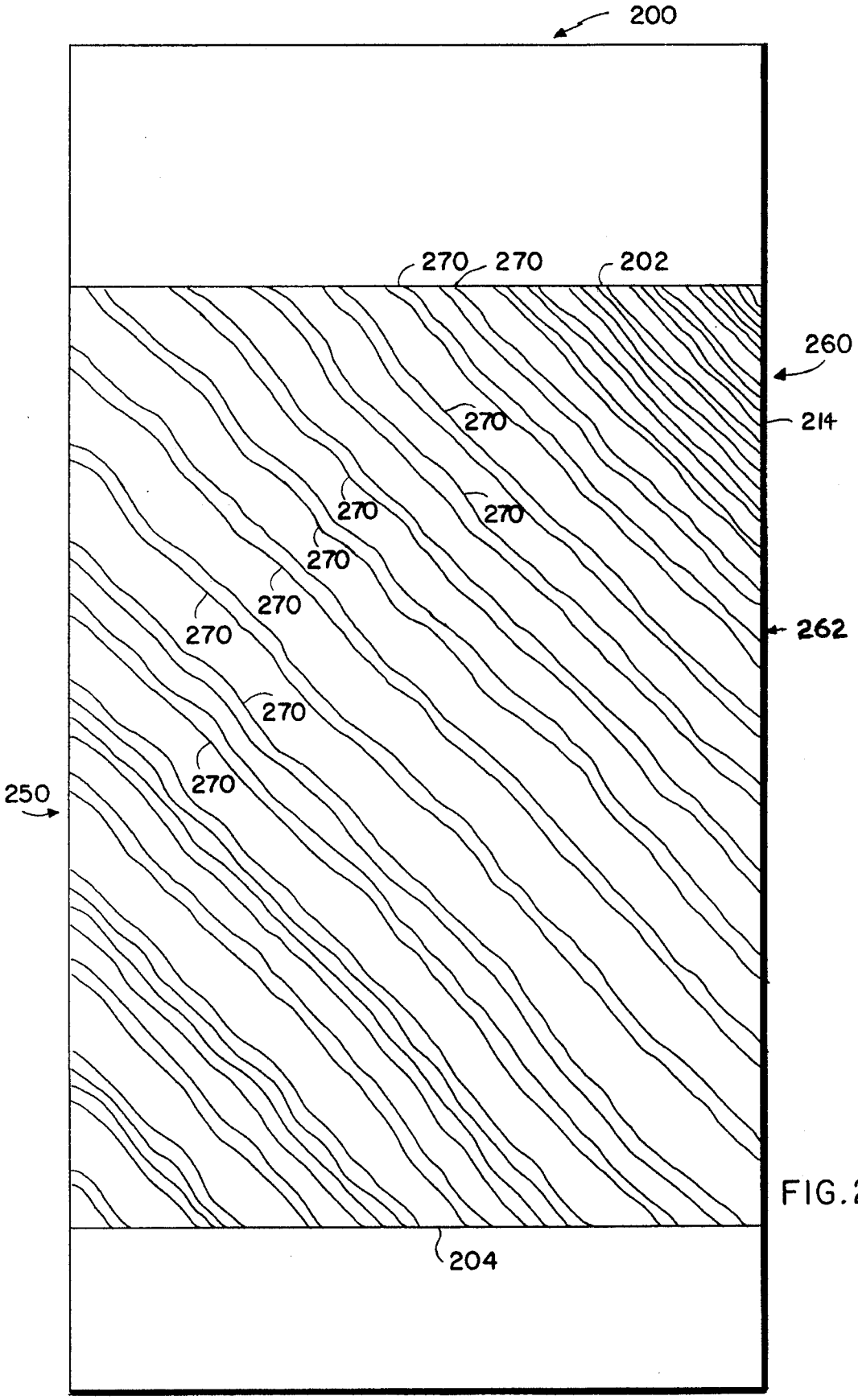
FIG. 2 is a plan view of a wood graining tool, on an enlarged scale, having a graining pattern for producing a quarter sawn wood grain pattern.

As shown in FIG. 2 a tool 200 presents a graining pattern 250 for simulating a quarter sawn wood grain. The pattern 250 presents a plurality of ribs 270 diagonally extending along the face of the tool and between the top lateral edge 202 and a side or longitudinal edge 214. The spacing between the diagonal ribs preferably increases from the upper right hand corner of the pattern 250 face and towards the center of the pattern 250. This spacing may then decrease as the diagonal ribs 270 approach the lower left hand corner as viewed. Thus, the ribs 270 are spaced farther apart as they move away from the corners and towards the center of the pattern 250. These ribs are preferably at an angle 40° to 50° relative to the horizontal so as to provide for effective pick up and transfer of the graining liquid by the ribs during tool use. Also, the width of the ribs 270 may increase as they approach the middle of the pattern.

Figure 7:
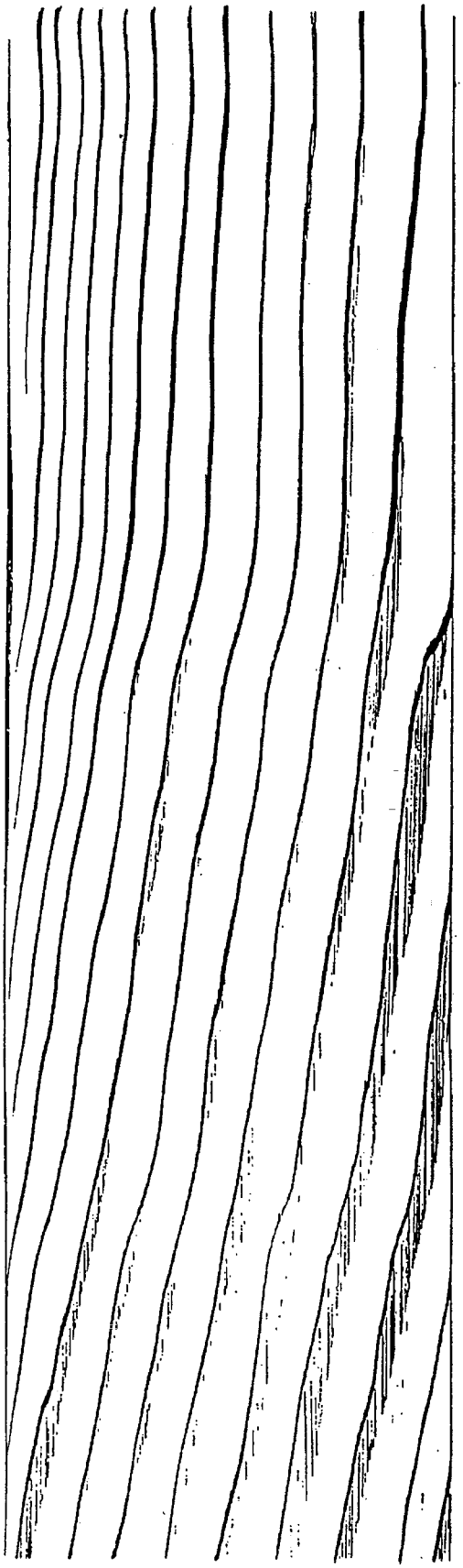
FIG. 7 is a plan view of an application surface having a quarter sawn wood grain pattern thereon.

The use of these diagonally spaced-apart ribs 270 provides an advantage over the prior art devices which utilize a comb having a plurality of fixed, parallel teeth. The teeth are drawn along the graining liquid on the application surface so as to provide the quarter sawn veins. In tool 200 the variable rib densities causes the number of ribs which are in contact with the application surface to change as the tool 200 is rolled along the application surface. As shown in the FIG. 2, there are 15 ribs of variously increasing spaces between the ribs contacting the application surface along horizontal zone 260. This contact density decreases to eight ribs at zone 262 of variously increasing spaces between the ribs and then increases again at the tool bottom. Thus, as tool 200 is rolled along its line of travel the points of contact with the application surface will vary. Accordingly, the vein pattern will change according to whether the tool 200 is rolled along the line of travel of the application surface, rolled and slid along the line of travel or slid only. A resulting quarter sawn pattern is as shown in FIG. 7.

Figure 4:
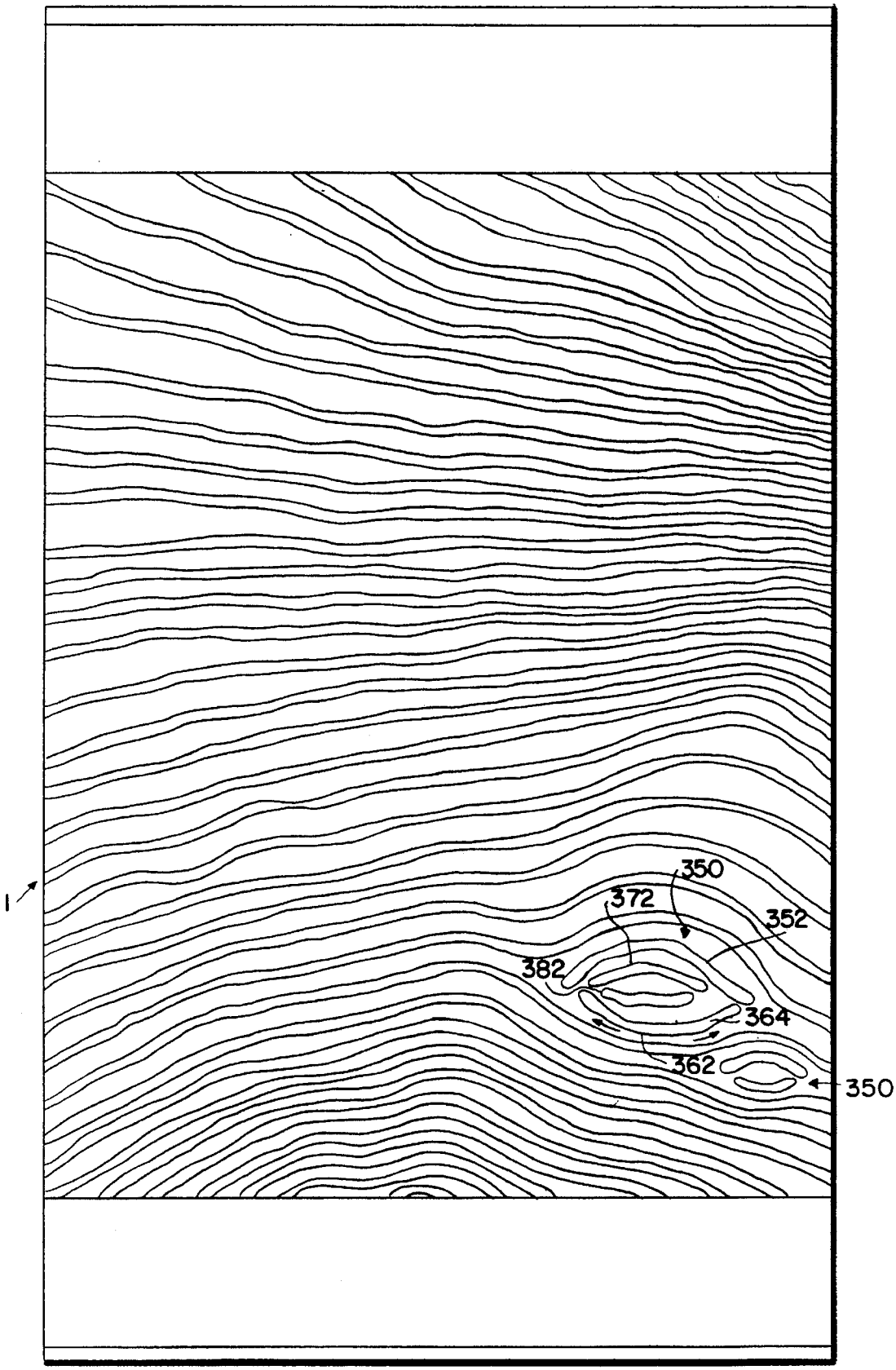
FIG. 4 is a plan view of a wood graining tool including a pattern for producing a rotary cut wood grain.
Figure 5:
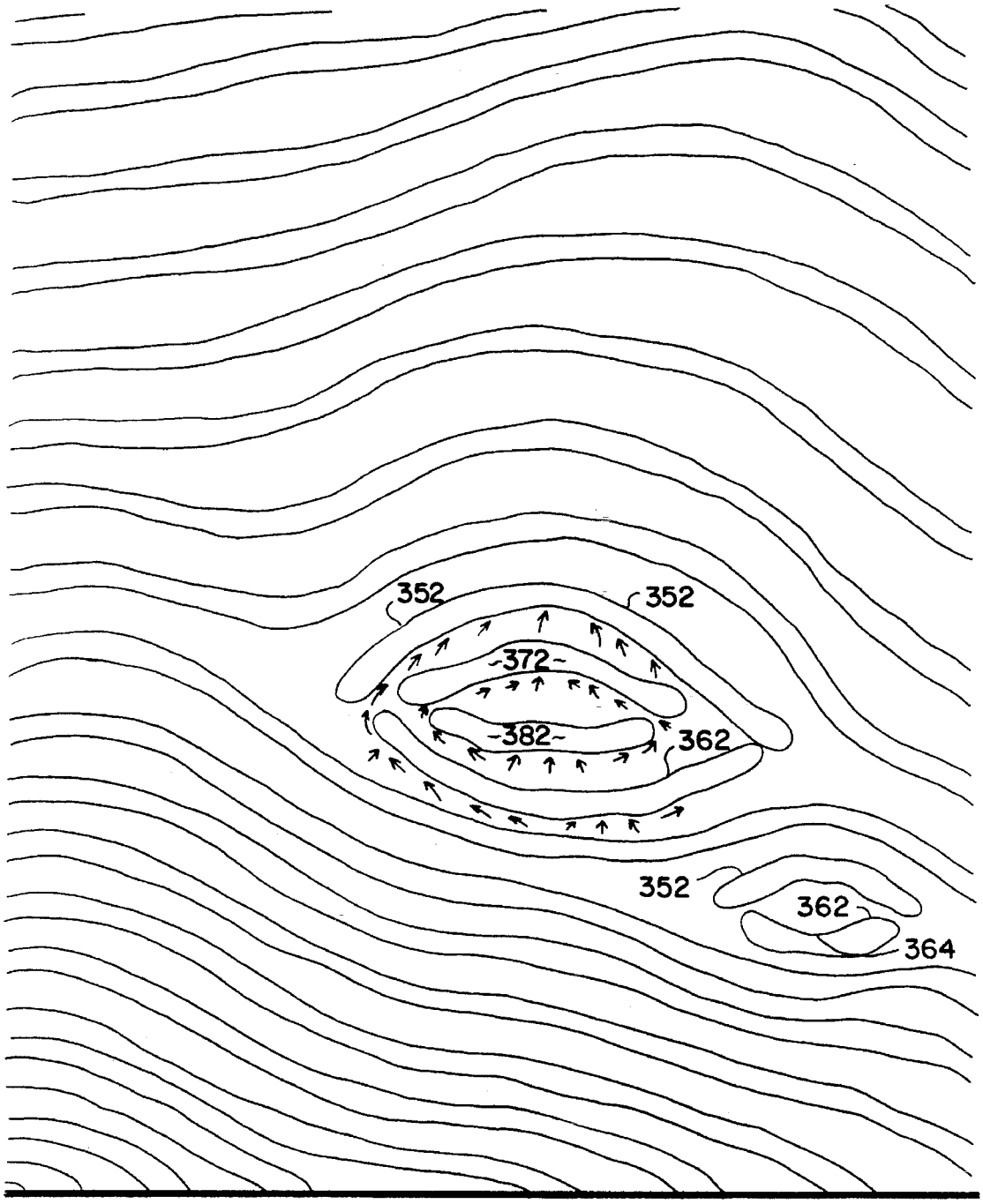
FIG. 5 is a plan view of a portion of the rotary cut pattern of FIG. 4 on an enlarged scale.

As further shown in FIGS. 4 and 5, a tool 300 with a rotary cut grain pattern 350 is presented. Located within this pattern 350 is a pair of ribs arranged to create a complete loop or loops of a rotary cut wood grain on the application surface. The rib array 350 may be incorporated into the plain sawn and quarter sawn patterns as above described.

An enlarged view of the rib array 350 is shown FIG. 5). A leading concave rib 352 which first contacts the application surface during the tool rotation is presented. (Although viewed as convex in the drawings the rib will be concave relative to its contact with the application surface, i.e. it will collect graining liquid thereon. Thus, it is designated as concave.) As the rib 352 is functionally concave it will collect the graining liquid at the center of rib 352. As the tool 300 continues to slide and roll along the application surface the rib 352 begins to lift off the application surface. A trailing functionally convex rib 362 then comes into contact with the application surface. As rib 362 is convex and has end points inwardly adjacent the ends of rib 352, the rib 362 funnels the liquid toward the end points of rib 352. As the sliding and rolling of tool continues the rib 362 will gradually lift off the surface causing a loop on the application surface to narrow and then close. Rib 362 funnels the graining liquid away from the center of the rib 362 such that less paint is at its center that at the center point of rib 352. Accordingly, a flattened, concave area 364 is placed on rib 362 at its midpoint. This concave area stores a portion of the graining liquid for transfer to the application surface. Thus, a matching of the shading of the grain on the application surface is provided.

Figure 9:
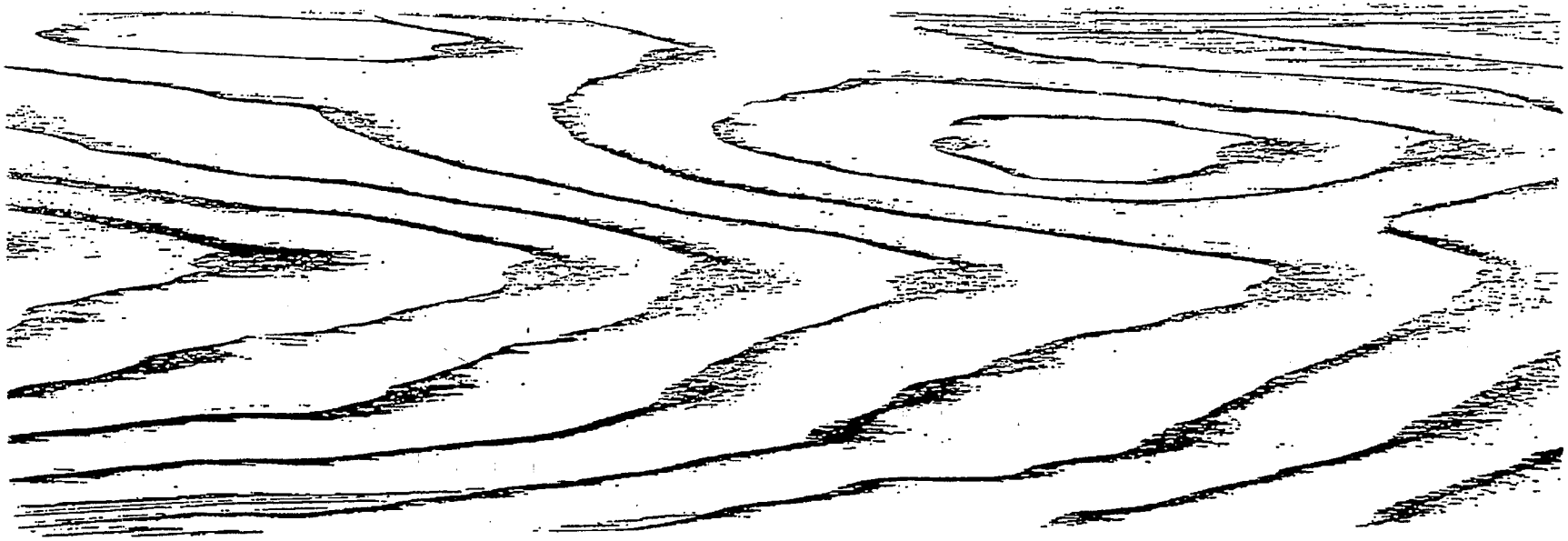
FIG. 9 is a view of an application surface showing a rotary cut wood grain pattern thereon.

As further shown, a second pair of concave and convex ribs 372, 382 may be within the first pair 352, 362. This arrangement may be utilized if a series of annular rings is desired. (See FIG. 9 for examples of graining patterns made by this tool.)

It is to be understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A wood graining tool having a graining pattern thereon and presented by a series of embossed ribs, said tool comprising:

a flexible panel for wrapping around a cylinder, said panel having a leading edge and a trailing edge relative to a direction of travel of the cylinder along an application surface prepared for receiving a wood grain pattern thereon;

a series of embossed ribs extending from said panel in spaced-apart relationships and traversing an imaginary longitudinal line generally extending between said leading edge and said trailing edge of said panel, each of said ribs comprising:

a central crown portion presented by an arc-like configuration of a generally fixed radius, the center point of said arc being along said longitudinal line in a spaced-apart relationship from a center point of an arc of an adjacent rib of said series of ribs, said arc including first and second ends;

first and second ridge portions respectively merging into said respective ends of said arc, each of said ridge portions extending from said are ends in an angular relationship of generally 40° to 50° relative to one of said edges.

2. The device as claimed in claim 1 further comprising a seat extending from at least one of said edges, said seat presenting a surface for placement of a finger of a user thereon during operation of said tool.

3. The device as claimed in claim 1 wherein said longitudinal line extends between a midpoint of said lower and upper edges.

4. A wood graining tool having a graining surface pattern thereon presented by a series of embossed ribs, said tool pattern comprising:

a flexible panel for wrapping around a cylinder, said panel having a pair of spaced-apart longitudinal edges and first and second lateral edges extending therebetween, said lateral edges generally normal to the direction of travel of the tool along an application surface prepared for receiving a wood grain pattern thereon;

a series of spaced-apart ribs diagonally extending between one of said lateral edges and a longitudinal edge.

5. The device as claimed in claim 4 wherein said spaced-apart relationship between each rib of said series of ribs increases as said ribs are positioned away from an intersection of one of said longitudinal and lateral edges and towards a center of said panel.

6. The device as claimed in claim 5 wherein said spaced-apart relationship between said ribs of each of said ribs decreases as each rib of said plurality of ribs approach an intersection of the other of said longitudinal edges and lateral edges.

7. In a wood graining tool having a graining pattern thereon the improvement comprising means for producing a ring within the graining pattern on an application surface, said means comprising:

a first concave rib in said graining pattern, relative to an application surface, having first and second laterally displaced ends, said first concave rib generally traversing a direction of travel of a tool along an application surface;

a second convex rib, relative to an application surface, and having a length less than said first concave rib, said second convex rib having first and second ends adjacent said ends of said first rib, said second rib channeling a graining liquid to said first rib during a rolling movement of said tool in a manner to form a ring on an application surface upon rotation of the wood graining tool.

8. The device as claimed in claim 7 further comprising a concave area at a general center point of said second rib to retard channeling of a portion of a graining liquid to said first rib ends.

* * * * *

UNITED STATES PATENT AND TRADEMARK OFFICE

CERTIFICATE OF CORRECTION

PATENT NO. : 5,507,064

DATED : April 16, 1996

INVENTOR(S) : Clifford M. King

It is certified that error appears in the above-indentified patent and that said Letters Patent is hereby corrected as shown below:

Column 6, line 25, delete "are" and substitute --arc--.

Signed and Sealed this

Twenty-third Day of July, 1996

*Attest:*

*Attesting Officer*

BRUCE LEHMAN

*Commissioner of Patents and Trademarks*